US011584902B2

(12) United States Patent
Bailly et al.

(10) Patent No.: US 11,584,902 B2
(45) Date of Patent: Feb. 21, 2023

(54) CLEANING PROCESS TO REMOVE RED OILS DEPOSITS IN AN INSTALLATION COMPRISING FATTY ACID ESTERS AS CLEANING AGENT AND USE OF FATTY ACID ESTERS AS CLEANING AGENT IN SUCH A PROCESS

(71) Applicant: TOTAL RESEARCH & TECHNOLOGY FELUY, Seneffe (BE)

(72) Inventors: Carole Bailly, Montivilliers (FR); Jean-Pierre Thoret Bauchet, Brussels (BE); Michel Laxnier, La Rivière Saint Sauveur (FR)

(73) Assignee: Total Research & Technology Feluy, Seneffe (BE)

( * ) Notice: Subject to any disclaimer, the term of this patent is extended or adjusted under 35 U.S.C. 154(b) by 427 days.

(21) Appl. No.: 16/650,778

(22) PCT Filed: Sep. 25, 2018

(86) PCT No.: PCT/EP2018/076029
§ 371 (c)(1),
(2) Date: Mar. 25, 2020

(87) PCT Pub. No.: WO2019/063573
PCT Pub. Date: Apr. 4, 2019

(65) Prior Publication Data

US 2020/0224130 A1 Jul. 16, 2020

(30) Foreign Application Priority Data

Sep. 26, 2017 (EP) ..... 17193049

(51) Int. Cl.
*B08B 3/04* (2006.01)
*C10G 75/04* (2006.01)
(Continued)

(52) U.S. Cl.
CPC ..... *C11D 7/5022* (2013.01); *B08B 9/0321* (2013.01); *C10G 75/04* (2013.01);
(Continued)

(58) Field of Classification Search
CPC ... B08B 3/04; B08B 9/0321; B08B 2209/032; C10G 75/04; C10G 2300/4075;
(Continued)

(56) References Cited

U.S. PATENT DOCUMENTS 5,194,143 A 3/1993 Roling
2018/0119025 A1* 5/2018 Lee ..... C10G 19/08

FOREIGN PATENT DOCUMENTS

WO 2011138305 A2 11/2011

OTHER PUBLICATIONS

International Search Report issued in Application No. PCT/EP2018/076029, dated Dec. 7, 2018; 3 pages.

* cited by examiner

*Primary Examiner* — Brian P Mruk
(74) *Attorney, Agent, or Firm* — Albert Shung

(57) ABSTRACT

The invention relates to a process for removing red oils deposits formed in an installation comprising the use of a cleaning agent comprising one or more fatty acid esters to dissolve the red oils deposit and to form a mixture comprising the cleaning agent and the dissolved red oils; and removing the mixture comprising the cleaning agent and the dissolved red oils.

20 Claims, 2 Drawing Sheets

(51) Int. Cl.

| | |
|---|---|
| ***C11D 7/44*** | (2006.01) |
| ***C11D 7/50*** | (2006.01) |
| ***B08B 9/032*** | (2006.01) |
| ***C11D 7/26*** | (2006.01) |
| ***C11D 7/40*** | (2006.01) |
| ***C11D 11/00*** | (2006.01) |

(52) U.S. Cl.
CPC ..... *C11D 7/266* (2013.01); *C11D 7/40* (2013.01); *C11D 11/0041* (2013.01); *B08B 2209/032* (2013.01); *C10G 2300/4075* (2013.01)

(58) Field of Classification Search
CPC ..... C11D 7/266; C11D 7/44; C11D 7/5022; C11D 11/0041
See application file for complete search history.

CLEANING PROCESS TO REMOVE RED OILS DEPOSITS IN AN INSTALLATION COMPRISING FATTY ACID ESTERS AS CLEANING AGENT AND USE OF FATTY ACID ESTERS AS CLEANING AGENT IN SUCH A PROCESS

CROSS-REFERENCE TO RELATED APPLICATIONS

This application claims the benefit of PCT/EP2018/076029 filed Sep. 25, 2018, which claims priority from EP 17193049.8 filed Sep. 26, 2017, which are incorporated herein by reference in their entireties for all purposes.

FIELD OF THE INVENTION

The present invention relates to processes for cleaning installation subjected to fouling by red oils deposits, such as basic wash units, caustic towers of steam crackers and all downstream units dealing with spent caustic. The invention relates to a curative process to be used in complement to known preventive processes that are directed to the inhibition or to the reduction of fouling deposits by red oils.

BACKGROUND OF THE INVENTION

In cracking operations, such as the pyrolytic steam cracking of ethane, propane, and naphthas to form olefins, oxygenated compounds including carbonyl compounds, such as aldehydes and ketones, are formed. When the gas stream is passed through a basic wash (with pH>7) to remove acidic components such as hydrogen sulfides and carbon dioxide, oxygen-containing compounds such as acetaldehyde will undergo under polycondensation in presence of the basic wash or scrubbing conditions. The polymers formed are also called "red oils" due to their colour. The caustics towers are sometimes treated with additives to reduce the fouling. As aldehydes are not completely converted in the caustic tower, reactions are ongoing in spent caustic. This is why all downstream units and storages dealing with spent caustic are also prone to fouling.

An example of a preventive method for inhibiting fouling systems in caustic scrubber systems is disclosed in U.S. Pat. No. 5,194,143. The method disclosed consists in adding an effective amount for the purpose of an acetoacetate ester compound to the caustic wash system.

Another example of a preventive method is given by WO2011/138305 and relates to a method for reducing the formation of fouling deposits occurring in a caustic scrubber used to remove acid gases. The method disclosed uses a solvent such as a hydrocarbon aromatics selected from benzene, toluene and xylenes, introduced in the caustic scrubber and/or in the alkaline solution fed to the scrubber.

The acetaldehyde dissolved in spent caustic remains reactive and red oils formation in downstream units goes on. This induces severe fouling of the downstream installation. Spent caustic storage can contain high quantities of polymers, for instance a thickness of 50 cm of polymers is not a surprise. These deposits are gummy and sticking. The installation must be shut down for cleaning which is a costly operation. In addition, the time spent can be long so that the installation can be non-available for more than 10 days.

Red oils deposits can be removed manually, but this method is of low acceptance because of risks for health and safety in the workplace for the operators (i.e. HSE risks). High-pressure cleaning shows low efficiency due to the gummy and sticking properties of the red oils deposits. The use of additives has also been suggested, but they have a partial efficiency as there are used in emulsion, they generate waste hard to treat.

Thus there is still a need to find methods to clean the red oils deposits formed in installations such as basic wash units and downstream equipment.

Thus an object of the invention is to provide a cleaning process to remove red oils deposits formed in installations such as basic wash units and downstream equipment. It is also an object of the invention to provide a cleaning process that is simple to implement, that shows low HSE risks, that is cost efficient, that is time efficient and/or that generates waste simply to treat.

SUMMARY OF THE INVENTION

According to a first aspect, the invention provides a process for removing red oils deposits formed in an installation comprising:

b) adding a cleaning agent comprising one or more fatty acid esters;

c) circulating the cleaning agent within the installation to dissolve the red oils deposit in the cleaning agent and to form a mixture comprising the cleaning agent and the dissolved red oils; and d) removing the mixture comprising the cleaning agent and the dissolved red oils.

It has been found by the inventors that surprisingly the fatty acid esters, and especially the fatty acid methyl esters have a great affinity for red oils. The fatty acid esters can be used to dissolve or reduce red oils viscosity creating a mixture that can be removed by a simple pump. The use of such a cleaning agent is particularly interesting as it does not require the operators to be exposed to harmful chemical substances and therefore does not increase the HSE risks. It allows the cleaning of the installation to be performed in one or less than one day in some cases, reducing the time wherein the installation is not available for maintenance reasons or partially stopped. Moreover, the waste generated (i.e. the mixture comprising the cleaning agent and the dissolved red oils) only contains hydrocarbons and can, therefore, be easily disposed of, for example by burning.

In an embodiment, the process comprises a step a) of washing the installation to remove a soda excess that is performed before the step b) of addition of the cleaning agent. With preference, in step a), washing is performed with water.

With preference, one or more of the following features can be used to further define the inventive process:

In step b), the one or more fatty acid esters are selected from fatty acid methyl esters, fatty acid ethyl esters and any mixture thereof, preferably in step b) the one or more fatty acid esters are selected from fatty acid methyl esters.

In step b), the cleaning agent is a biodiesel.

In step b), the one or more fatty acid esters added are selected to have a carbon chain length ranging from 4 to 36 carbon atoms, preferably from 8 to 24 carbon atoms, more preferably from 10 to 22 carbon atoms and even more preferably from 14 to 20 carbon atoms.

In step b), the one or more fatty acid esters are selected to have a flash point above 50° C., preferably above 80° C., more preferably above 100° C.

In step b), the one or more fatty acid esters are added to the red oils at a weight ratio fatty acid esters to red oils, that is in the range of 0.05:1 to 50:1, preferably at a weight ratio fatty acid esters to red oils in the range of 0.2:1 to 10:1, more preferably in the range of 0.5:1 to 5:1 and even more preferably of 1:1.

Step c) is performed at a temperature ranging from 0 to 150° C., preferably ranging from 20 to 130° C., and more preferably from 50 to 110° C.

Step c) is performed by recirculating pumps and/or by high-pressure injectors and/or gas bubbling.

Step c) is performed during installation shutdown or operation, preferably step c) is performed during installation operation by gas bubbling.

Step d) of removing the mixture comprising the cleaning agent and the dissolved red oils is performed by pumping or draining said mixture.

The process further comprises a step of determination of the volume and/or of the weight of the red oils deposit to be removed. This step is made during the preparation phase.

The installation is a basic wash unit and/or a downstream equipment of a basic wash unit, preferably the basic wash unit is using caustic soda and is selected from a caustic tower, a caustic scrubber, a caustic wash downstream, an amine gas scrubber, wherein the basic wash unit preferably includes all related equipment selected from pumps, piping and settlers; and preferably the downstream equipment of a basic wash unit is selected from a spent caustic settler, a spent caustic washer, a spent caustic mixer, a spent caustic storage, a spent caustic oxidizer, a spent caustic neutralizing drum, a spent caustic stripper.

In an embodiment, the dissolution of the red oils deposit in the cleaning agent during step c) is monitored by measuring the density and/or the viscosity of the mixture and the step c) is ended when:

the density measured is constant within time or when the density measured reaches a target density determined by laboratory testing; and/or the viscosity of the mixture and the step c) is ended when the viscosity is constant within time or when the viscosity measured reaches a target density determined by laboratory testing.

In another embodiment, the dissolution of the red oils deposit in the cleaning agent during step c) is monitored by attenuated total reflectance (ATR) Fourier transform infrared (FTIR) spectroscopy and the step c) is ended when the addition of fresh cleaning agent in the installation provides no further increase results in ATR-FTIR analysis, or by comparison of the Fourier transform of the interferogram of the mixture to the Fourier transform of the interferogram of a reference sample.

According to a second aspect, the invention relates to the use of one or more fatty acid esters as cleaning agent in a process for removing red oils deposit from an installation, wherein the use comprises dissolving the red oils deposit in the fatty acid esters.

The process is the process according to the first aspect, thus preferably the one or more fatty acid esters are selected from fatty acid methyl esters, fatty acid ethyl esters and any mixture thereof. More preferably the one or more fatty acid esters are selected from one or more fatty acid methyl esters.

In a preferred embodiment, the one or more fatty acid esters are selected to have:

a carbon chain length ranging from 4 to 36 carbon atoms, preferably from 8 to 24 carbon atoms, more preferably from 10 to 22 carbon atoms and even more preferably from 14 to 20 carbon atoms a flash point above 50° C., preferably above 80° C., more preferably above 100° C.

In an embodiment, the one or more fatty acid esters are a biodiesel.

In an embodiment, the use comprises:

dissolving the red oils in one or more fatty acid esters at a temperature ranging from 0 to 150° C., preferably ranging from 20 to 130° C., and more preferably from 50 to 110° C.

washing the installation, preferably with water, prior to the addition of one or more fatty acid esters in order to remove, at least partially, a soda excess.

DETAILED DESCRIPTION OF THE INVENTION

Figure 1:
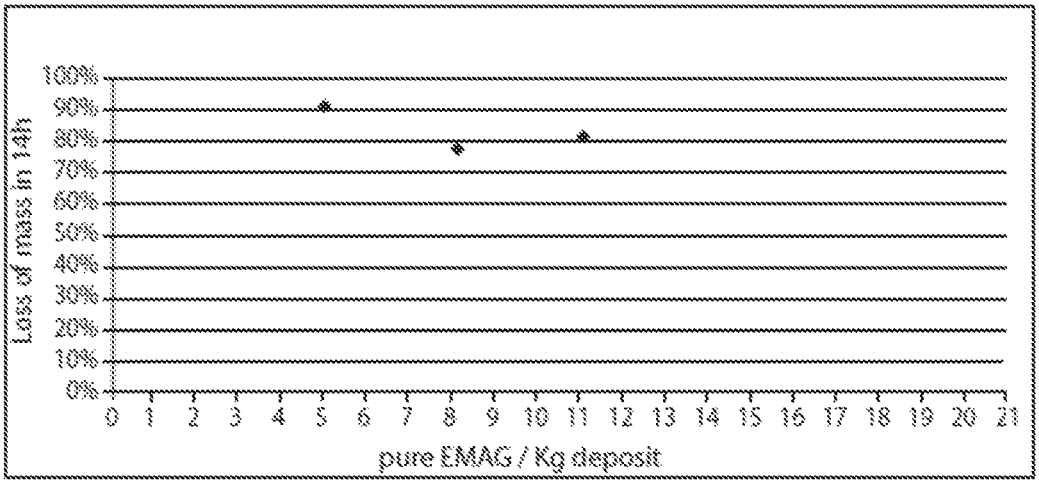
FIG. 1 is a graph illustrating the results of saturation tests.

For the purpose of the invention the following definitions are given:

"Red oils" is a term that describes an organic contaminant frequently encountered in caustic towers. The "red oils" are formed from an organic polymer that forms from the aldol condensation of acetaldehyde in sodium hydroxide solution. Initially, the acetaldehyde forms a light floating yellow oil that continues to polymerize into a more familiar orangish/red colour—hence the term "red oil". These red oils form more sticky heavy oils that are difficult to separate. This causes fouling and plugging issues in the caustic tower and downstream spent caustic handling systems.

Fatty acid esters are a type of ester that results from the combination of a fatty acid with an alcohol. When the alcohol component is glycerol, the fatty acid esters produced can be monoglycerides, diglycerides, or triglycerides.

Biodiesels are typically fatty acid esters produced by the transesterification of vegetable fats and oils which results in the replacement of the glycerol component with a different alcohol.

Fatty Acid Methyl Esters (FAME) are esters of fatty acids. The physical characteristics of fatty acid esters are closer to those of fossil diesel fuels than pure vegetable oils, but properties depend on the type of vegetable oil. A mixture of different fatty acid methyl esters is commonly referred to as biodiesel, which is a renewable alternative fuel. FAME has physical properties similar to those of conventional diesel. It is also non-toxic and biodegradable.

The process of the invention is a process for removing red oils deposits formed in a basic wash unit and/or in its downstream equipment. According to the invention, preferably the basic wash unit is using caustic soda and is selected from a caustic tower, a caustic scrubber, a caustic wash downstream an amine gas scrubber, wherein the basic wash unit preferably includes all related equipment selected from pumps, piping and settlers; and preferably the downstream equipment of a basic wash unit is selected from a spent caustic settler, a spent caustic washer, a spent caustic mixer, a spent caustic storage, a spent caustic oxidizer, a spent caustic neutralizing drum, a spent caustic stripper. This process is a curative process that differs from a preventive process in that the basic wash unit is not or partially not in use during the maintenance operation.

The process comprises the following steps:

b) adding a cleaning agent comprising one or more fatty acid esters;

c) circulating the cleaning agent within the installation to dissolve the red oils deposit in the cleaning agent and to form a mixture comprising the cleaning agent and the dissolved red oils; and d) removing the mixture comprising the cleaning agent and the dissolved red oils.

The inventive process uses a cleaning agent comprising a solvent to dissolve the red oils wherein said solvent comprises one or more fatty acid esters. Among the solvents that could be used, fatty acid esters have been found to be preferred because of their good affinity with the red oils and also because they are bio-sourced. Moreover, their use does not increase the risk for health and safety in the workplace for the operators during the cleaning. This is of importance because the basic wash units may contain caustic soda, sulphides, benzene products, etc. Another advantage of the use of fatty acid esters is that they do not lead to corrosion problems.

In a preferred embodiment of the invention, the process comprises an optional step a) of washing the installation to remove at least partially a soda excess. Step a) is performed before the step b) of addition of the cleaning agent. This step enhances the efficiency of the cleaning process by protecting the one or more fatty acid esters against too much hydrolysis. This washing is preferably performed with water.

In a preferred embodiment of the invention, the process also includes an optional step of determination of the quantity of the red oils deposit to be removed, preferably from the volume and/or of the weight of the red oils deposit to be removed. This step can be performed before the washing step a) or after said washing step a) when a washing step a) is conducted. The determination step is performed by defining the volume of the red oils deposit within the installation. Said volume is determined by measuring or evaluating the thickness of the layer of the red oils deposit. The evaluation can also be done using historical data. This determination does not need to be accurate, and allows to provide an assistance to a first determination of the quantity of fatty acid esters that will be needed to clean the installation in step b). The other criteria to determine the needed quantity of fatty acid esters is to use the minimum volume required to allow a circulation in the installation.

In step b) of the process, the cleaning agent is added and put into contact with the red oils deposit. According to the invention, the cleaning agent is one or more fatty acid esters and is preferably selected from fatty acid methyl esters, fatty acid ethyl esters and any mixture thereof. Preferably, in step b), the one or more fatty acid esters are one or more fatty acid methyl esters (FAME). In a preferred embodiment, the cleaning agent is a biodiesel. Preferably the cleaning agent is used pure, i.e. without being dissolved in water.

In a preferred embodiment of the invention, the one or more fatty acid esters added are selected to have a carbon chain length ranging from 4 to 36 carbon atoms, preferably from 8 to 24 carbon atoms, more preferably from 10 to 22 carbon atoms and even more preferably from 14 to 20 carbon atoms. In a preferred embodiment, the one or more fatty acid esters added have a carbon chain length of 18 carbon atoms. It has been found by the inventors that long-chain fatty acid esters are more efficient than the shortest ones, as the red oils also show long carbon chains.

Fatty acid esters with high flash point have been found to be more efficient to dissolve the red oils. Thus preferably, the one or more fatty acid esters are selected to have a flash point above 50° C., preferably above 80° C., more preferably above 100° C., even more preferably above 120° C., and most preferably above 160° C. The flash point is the lowest temperature at which vapours of the material will ignite when given an ignition source.

The volume or the weight of the one or more fatty acid esters to be added in step b) is to be selected according to the solubility of the red oils deposit within the fatty acid ester. As the process may comprise one or more sequence of steps b) to d), it is also possible to add a fixed volume and/or weight of fatty acid esters to the basic washing unit and to repeat the sequence of steps b) to d) until the red oils deposit has been entirely dissolved and removed by pumping.

In an embodiment of the invention, the content of the one or more fatty acid esters to be added in step b) is at least the content of the red oils deposit to be removed. For instance, if the weight content of red oils deposit to be removed is determined to be about 30 tons, then the weight content of fatty acid esters to be added is 30 tons or more, such as 40 tons for instance. The ratio can be forced by the design of the equipment to be able to ensure recirculation and the number of batches that are planned by the operator. Thus preferably, the one or more fatty acid esters are added to the red oils at a weight ratio in the range of 0.2:1 to 10:1, preferably at a weight ratio fatty acid esters to red oils in the range of 0.2:1 to 10:1, more preferably in the range of 0.5:1 to 5:1, even more preferably of 1:1.

Once the one or more fatty acid esters have been introduced within the installation, they are circulated within the installation in step c) of the process. This circulation of the fatty acid esters can be done by recirculation pumps or by high-pressure injectors and/or gas bubbling. The gas used for gas bubbling includes nitrogen, steam, process gas, etc. The cleaning operation can be performed during installation shutdown or operation. When it is performed during installation operation; the process gas is used to create the bubbling and turbulence of the fatty acid esters. The circulation of the fatty acid esters facilitates the dissolution of the red oils deposit by creating turbulence. Any agitating means can also be used to achieve an agitation of the fatty acid esters in the installation. Turbulence plays a role in cleaning operation, decreasing the time needed to achieve the result.

In an embodiment of the invention, the step c) of circulating the one or more fatty acid esters in the installation is performed at a temperature ranging from 0° C. to 150° C., preferably from 20° C. to 130° C. more preferably from 50° C. to 110° C. For instance the step c) of circulating the fatty acid esters in the installation is performed at 80° C. The installation can be provided with heating means for this purpose.

In an embodiment, step c) of circulating the one or more fatty acid esters in the installation is monitored in order to follow the saturation of the cleaning agent. When the cleaning agent is saturated, the red oils deposit does not dissolve anymore and the mixture is to be removed. If the quantity of cleaning agent was not sufficient to dissolve entirely the red oils deposits, then the steps b) to d) can be performed again. The monitoring of the dissolution of the red oils deposit in the cleaning agent can be performed by different methods.

In an embodiment, the monitoring is performed by monitoring the density of the mixture of the cleaning agent and the dissolved red oils. Indeed, it has been found that during dissolution, the density is increased until a defined level where it becomes constant. According to the invention the step c) of dissolving the red oils in the cleaning agent is ended when monitoring the density of the mixture and the step c) is ended when the density is stabilized showing that there is no further Red Oils dissolution or reached the target density determined by laboratory testing.

In an embodiment, the step c) is ended when the graph displaying the results of the monitoring of the density of the mixture shows an asymptote. In another embodiment, the step c) is ended when the density increase of the mixture is above 0.30 g/cm3 as determined at 30° C. as determined using density meter DMA35N from Antoon Parr.

In another embodiment, the monitoring of the dissolution of the red oils deposit in the cleaning agent during step c) is performed by monitoring the mixture by attenuated total reflectance (ATR) Fourier transform infrared (FTIR) spectroscopy and the step c) is ended by comparison of the Fourier transform of the interferogram of the mixture to the Fourier transform of the interferogram of a reference sample.

In another embodiment, the monitoring of the dissolution of the red oils deposit in the cleaning agent during step c) is performed by monitoring the viscosity of the mixture and the step c) is ended when the viscosity is stabilized showing that there is no further Red Oils dissolution.

Tests Methods

The flash point is measured according to ISO3679.

The density of the mixture of fatty acid esters and dissolved red oils was determined using density meter DMA35N from Antoon Parr. The DMA 35N portable density meter measures the density of liquids in g/cm$^3$ or kg/cm$^3$ according to the U-tube principle.

The absorbance of the mixture of fatty acid esters and dissolved red oils was determined using ATR-FTIR.

The capability of the FTIR (Fourier Transform Infra Red) is to identify functional groups. FTIR relies on the fact that the most molecules absorb light in the infra-red region of the electromagnetic spectrum. This absorption corresponds specifically to the bonds present in the molecule. The frequency range is measured as wave numbers typically over the range 4000-600 cm-1. Attenuated total reflection (ATR) is a sampling technique used in conjunction with infrared spectroscopy which enables samples to be examined directly in the solid or liquid state without further preparation.

The viscosity of the mixture of fatty acid esters and dissolved red oils was determined using ANTON PAAR's viscosimeter SVM 3000. It is a rational viscometer with a cylinder geometry. It is based on a modified Couette principle.

EXAMPLES

Example 1: Efficiency of Cleaning Agents

Different cleaning agents have been tested:

CA1 is a mixture of fatty acid methyl esters (FAME) with 80 wt % of methyl ester of rapeseed, and 20 wt % of methyl palm ester. CA1 was used pure (not dissolved within water).

CA2 is a cleaning product commercially available from GE under the commercial product range Custom clean. CA2 is a polymer in aqueous alkaline solution, soluble in water.

CA3 is a polymerization inhibitor commercially available from GE under the commercial product range PETROFLO. CA3 is an alkaline aqueous product of organic and inorganic salts soluble in water.

CA4 is a cleaning product commercially available from NALCO under the commercial product range Arsenal™. CA4 contains isopropanol and is soluble in water.

CA5 is a cleaning product commercially available from NALCO under the commercial product range Enterfast™. CA5 is an aromatic composition comprising esters derived from phosphoric acid and butoxy-2-ethanol. CA5 is soluble in hydrocarbons.

The tests were performed under the following test protocol. The tests were carried out on a block of red oils of 50-70 cm$^3$. The volume of cleaning agent added was 250 mL. The mixture was stirred at moderate magnetic stirring and the reaction temperature was maintained at 80° C. The loss of mass was followed up during the tests. The results have been reported in table 1. The loss of mass percentage is based on the initial mass of the red oils.

| | CA1 | CA2 | CA2 | CA3 | CA4 | CA5 |
|---|---|---|---|---|---|---|
| Dilution in water | no | 5% v/v | 20% v/v | 5% v/v | 5% v/v | 50% v/v |
| Loss of mass of the red oils resulting from dissolution within the cleaning agent | 82 wt % | 33 wt % | no | no | 5 wt % | 86 wt % |
| Duration of the test | 14 hours | 14 hours | 14 hours | 14 hours | 14 hours | 2 hours |

CA5 shows very good results but is harmful to the environment. From the results, it can be seen that the kinetics of the reaction cannot be raised by raising the concentration of the cleaning agent. Surprisingly, CA1 shows very good results for dissolution of the red oils.

Example 2: Effect of Dilution and of Addition of Detergent

The mixture of fatty acid methyl esters (FAME) of CA5 with a detergent has been tested diluted in water 10 vol %. Different detergents were tested such as basic detergent and acid detergent. The tests were performed according to the same test protocol as in example 1. The results were not conclusive as no loss of mass was observed.

Example 3: Effect of the Temperature

Tests with a mixture of FAME comprising 60 wt % of methyl ester of rapeseed and 40 wt % of methyl palm ester were performed under the same test protocol except for the temperature that was selected to be 20° C. or 80° C. The mixture was used pure, i.e. not diluted. The results of the tests show an influence of the temperature on the kinetics of the reaction. Indeed, the similar loss of mass was achieved after 24 hours at 20° C. and after 1.5 hours at 80° C.

Example 4: Effect of the Ratio FAME/Red Oil

Tests have been performed to determine the suitable content of FAME (80 wt % of methyl ester of rapeseed; 20 wt % of methyl palm ester) to be added to a predetermined content of red oil. The results have been reported in FIG. 1, the duration of the test was 14 hours. From the results, it can be shown that the saturation point is not yet reached with 5

L of FAME per kilogram of red oil. The average volumetric mass of FAME was found to be about 550-600 g/L.

Example 5: Following the Reaction by Monitoring the Density of the Mixture

Figure 2:
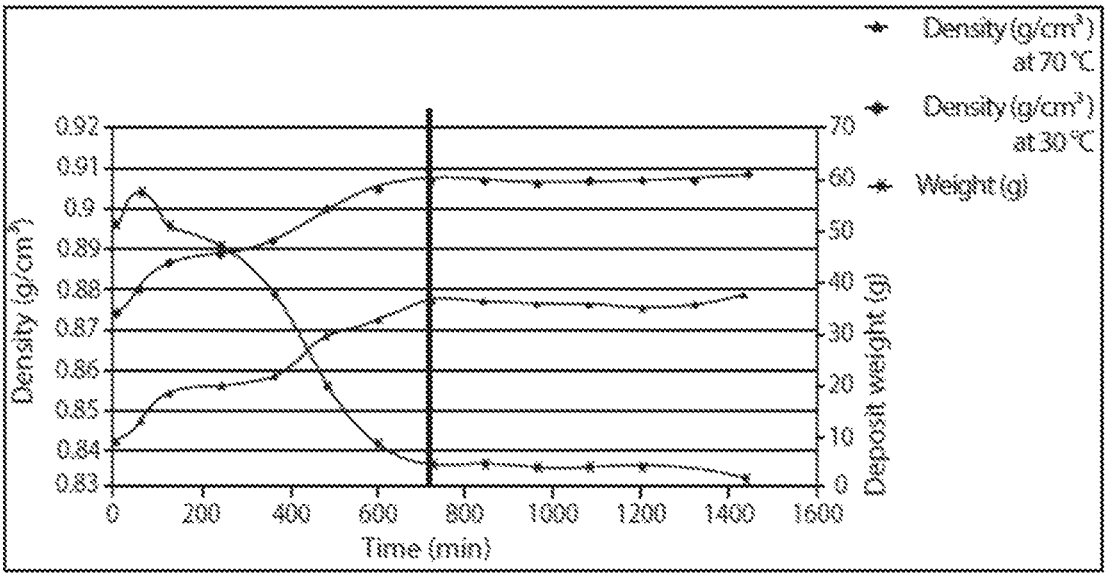
FIG. 2 is a graph illustrating the evolution of the density of the mixture of fatty acid esters and red oils during the dissolution step of the red oils.

The test was performed at an industrial scale on a column of 8 $m^3$ containing about 1 $m^3$ of red oils. 2 $m^3$ of FAME was added, the temperature was 80° C., and the duration of the test was over 14 hours. To follow the evolution of the reaction density measurements were performed. The density has been measured at 70° C. and at 30° C. The results are reported in FIG. 2. The results show an increase of the density until saturation is reached. When saturation has reached a level is reached. The results also show that different temperatures can be used to perform the measurement, but that once a test temperature is selected, all the measurements should be performed according to said temperature.

Example 6: Following the Reaction by Monitoring the Colourimetry of the Mixture

Figure 3:
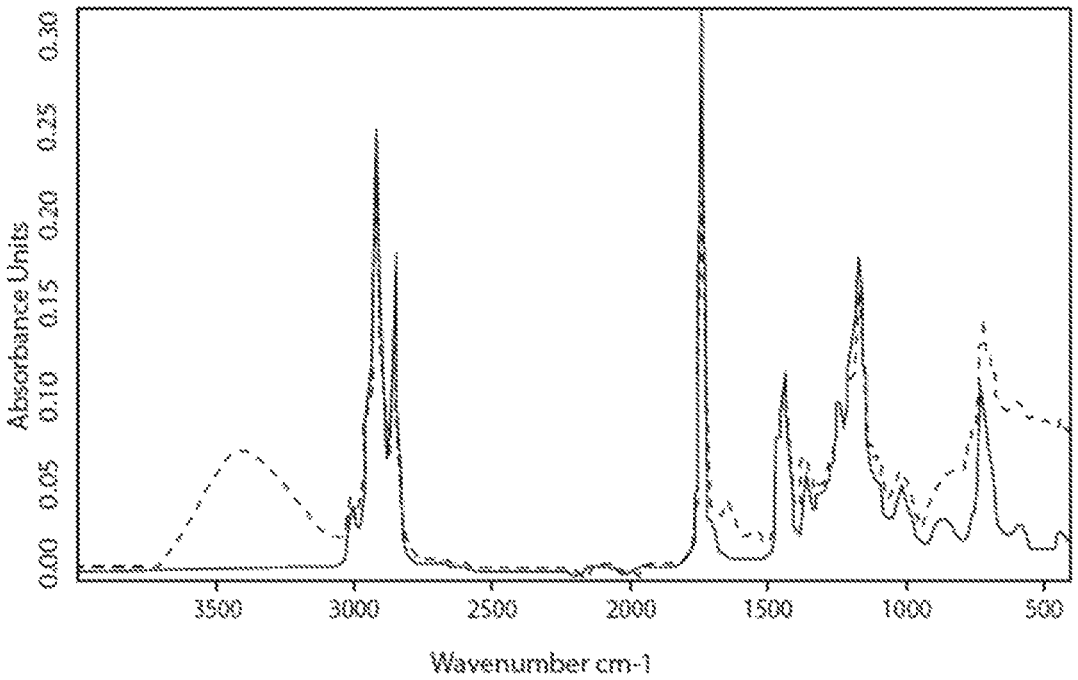
FIG. 3 is the superposition of FTIR graphs illustrating the change of colour of the cleaning agent due to the dissolution of red oils.

FTIR tests have been performed on fatty acid esters and on the mixture of fatty acid esters with dissolved red oils. The results are presented in FIG. 3. It can be seen that the dissolution of the red oils in the FAME results in a change of colour of the mixture. This change of colour is visible to the naked eyes and can be used to assess the success of the cleaning operation.

Example 7: Following the Reaction by Monitoring the Viscosity of the Mixture

Tests have been performed on fatty acid esters and on the mixture of fatty acid esters with dissolved red oils. The viscosity is measured after filtration over 5 μm filter. The results have been reported in table 2.

TABLE 2

| | CA1 (test 1) | CA1 (test 2) |
|---|---|---|
| Viscosity clean | 4.310 $mm^2/s$ | 4.564 $mm^2/s$ |
| Viscosity after dissolution | 5.232 $mm^2/s$ | 6.080 $mm^2/s$ |

It can be seen that the dissolution of red oils in the FAME results in an increase in the viscosity. This change of density can be used to assess the success of the cleaning operation.

The invention claimed is:

1. A process for removing red oils deposits formed in an installation comprising:

b) adding a cleaning agent comprising one or more fatty acid esters;

c) circulating the cleaning agent within the installation to dissolve the red oils deposit in the cleaning agent and to form a mixture comprising the cleaning agent and the dissolved red oils; and d) removing the mixture comprising the cleaning agent and the dissolved red oils.

2. The process of claim 1, further comprising a step a) of washing the installation to remove a soda excess that is performed before the step b) of addition of the cleaning agent.

3. The process of claim 1 wherein in step b), the one or more fatty acid esters comprises fatty acid methyl esters, fatty acid ethyl esters or any mixture thereof.

4. The process of claim 1 wherein in step b), the cleaning agent is a biodiesel.

5. The process of claim 1 wherein in step b), the one or more fatty acid esters added have a carbon chain length ranging from 4 to 36 carbon atoms.

6. The process of claim 1 wherein in step b), the one or more fatty acid esters have a flash point above 50° C.

7. The process of claim 1 wherein step c) is performed at a temperature ranging from 0 to 150° C.

8. The process of claim 1 wherein step c) is performed by recirculating pumps and/or by high-pressure injectors and/or gas bubbling.

9. The process of claim 1 wherein in step c) is performed during installation shutdown or operation.

10. The process of claim 1 wherein the dissolution of the red oils deposit in the cleaning agent during step c) is monitored by measuring the density and/or the viscosity of the mixture and in that the step c) is ended when:

the density measured is constant within time or when the density measured reaches a target density determined by laboratory testing; and/or the viscosity of the mixture and the step c) is ended when the viscosity is constant within time or when the viscosity measured reaches a target density determined by laboratory testing.

11. The process of claim 1 wherein the dissolution of the red oils deposit in the cleaning agent during step c) is monitored by attenuated total reflectance (ATR) Fourier transform infrared (FTIR) spectroscopy and in that the step c) is ended when the addition of fresh cleaning agent in the installation provides no further increase results in ATR-FTIR analysis, or by comparison of the Fourier transform of the interferogram of the mixture to the Fourier transform of the interferogram of a reference sample.

12. The process of claim 1 wherein the removing the mixture comprising the cleaning agent and the dissolved red oils in step d) is performed by pumping said mixture.

13. The process of claim 1, further comprising a step of determining the volume and/or of the weight of the red oils deposit to be removed.

14. The process according to claim 1, wherein the installation comprises a basic wash unit and/or downstream equipment of the basic wash unit, wherein the basic wash unit uses caustic soda and comprises a caustic tower, a caustic scrubber, a caustic wash downstream of an amine gas scrubber.

15. A process for removing red oils deposit from an installation, the process comprising: utilizing one or more fatty acid esters as cleaning agent, wherein utilizing comprises dissolving the red oils deposit in the one or more fatty acid esters, and wherein the fatty acid esters comprising fatty acid methyl esters, fatty acid ethyl esters or a mixture thereof.

16. The process of claim 15 wherein the one or more fatty acid esters comprise:

a carbon chain length ranging from 4 to 36 carbon atoms; and/or a flash point above 100° C.

17. The process of claim 15 wherein the one or more fatty acid esters have a carbon chain length from 8 to 24 carbon atoms.

18. The process of claim 1 wherein in step b), the one or more fatty acid esters added have a carbon chain length ranging from 8 to 24 carbon atoms.

19. The process of claim 1 wherein in step b), the one or more fatty acid esters added have a carbon chain length ranging from 10 to 22 carbon atoms.

20. The process of claim 1 wherein in step b), the one or more fatty acid esters added have a carbon chain length ranging from 14 to 20 carbon atoms.

* * * * *